United States Patent [19]

Drell

[11] 4,273,436

[45] Jun. 16, 1981

[54] DEVICE FOR SUPPORTING AND PREVENTING CURLING OF PHOTOGRAPHIC FILM DURING DEVELOPING THEREOF

[75] Inventor: Philip Drell, Skokie, Ill.

[73] Assignee: Sima Products Corporation, Chicago, Ill.

[21] Appl. No.: 106,031

[22] Filed: Dec. 21, 1979

[51] Int. Cl.[3] ..... G03D 13/08

[52] U.S. Cl. ..... 354/344; 248/339; 350/243; 350/251

[58] Field of Search ..... 354/340, 342, 344, 345, 354/346; 248/339, 340; 350/239, 243, 244, 251

[56] References Cited

U.S. PATENT DOCUMENTS

| | | | |
|---|---|---|---|
| 2,991,334 | 7/1961 | Wandel | 350/243 |
| 3,782,559 | 1/1974 | Wright | 248/339 |
| 4,192,602 | 3/1980 | Lamoreaux, Jr. | 354/340 |

*Primary Examiner*—F. L. Evans

*Attorney, Agent, or Firm*—Silverman, Cass & Singer, Ltd.

[57] ABSTRACT

A device for supporting a strip of photographic film and for preventing the same from curling during the drying step of developing thereof. A body portion is provided with at least one pair of hook members extending from an edge thereof. The hook members are arranged spaced apart on said edge to enable them to pass through and be positioned within the sprocket holes adjacent end frames of the film strip. One such device may be positioned at the top of a strip of film to support the same on a hanging line or pin for drying; a second device may be positioned at the bottom edge of the film strip to prevent the same from curling during said drying of the strip.

5 Claims, 4 Drawing Figures

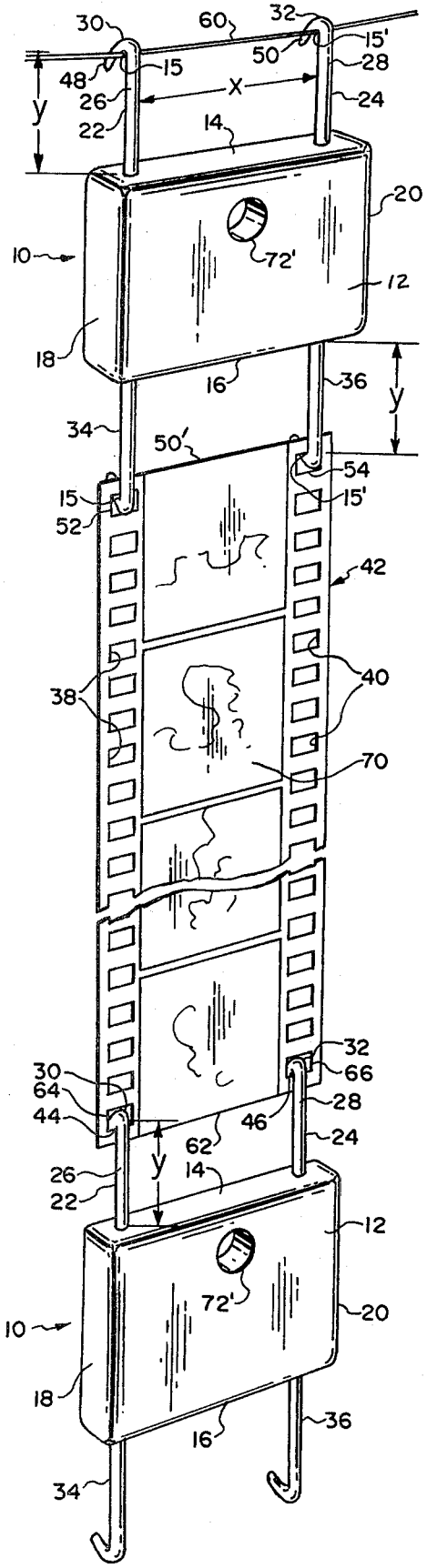
FIG. 1
FIG. 2
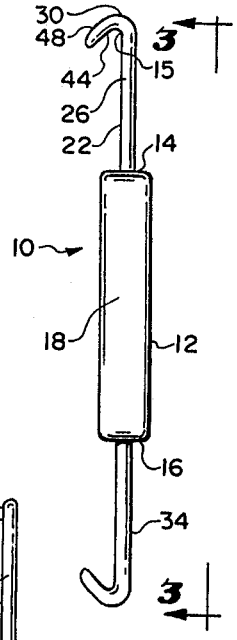
FIG. 3
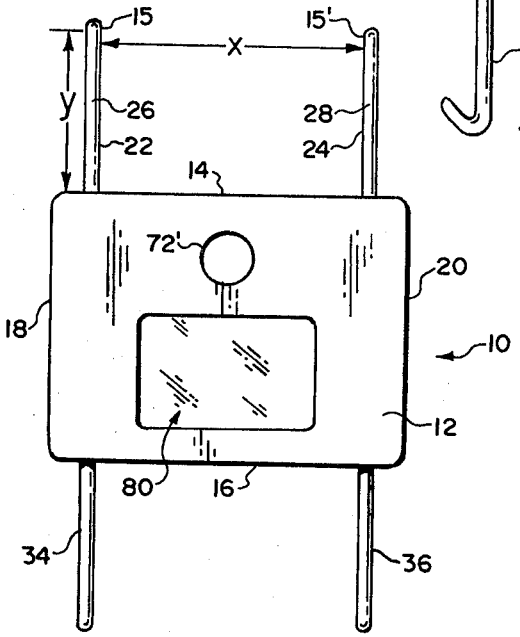
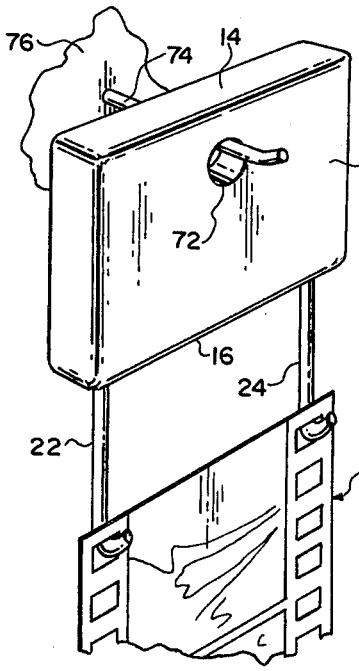
FIG. 4

DEVICE FOR SUPPORTING AND PREVENTING CURLING OF PHOTOGRAPHIC FILM DURING DEVELOPING THEREOF

BACKGROUND OF THE INVENTION

1. Field of the Invention

This invention relates generally to devices for use during developing of photographic film and more particularly, to such a device for supporting a strip of photographic film and for preventing the same from curling during the drying step of developing thereof.

2. Description of the Prior Art

One of the steps involved in developing photographic film is drying. When such film is in the form of a strip such as that of the 35 mm type, the strip generally is suspended from a drying line to hang in the air for complete drying of the development liquids applied thereto. Commonly, a pinch clip or the like is engaged upon the edge of one terminal frame of the film strip which has been subjected to developing liquids, and the clip is attached to a horizontal line so that the wet film strip will be suspended in the air to dry. The clip is disengaged from the line and the film strip when the same has dried.

Film strips which are suspended in the air by a clip to dry have a tendency to curl at the bottom portion thereof and it therefore is common practice to use some means to weight the bottom edge to prevent such curling. Generally, a releasable weight is affixed to the free end of the film strip along the lower edge thereof to retard the curling tendency of the strip. Such releasable weight may be the same type of pinch clip which is used to enable suspension of the strip upon the horizontal drying line.

The use of pinch clips of the type described gives rise to certain disadvantages. The clips must be applied directly to the film surface at the top and/or bottom of the film strip and therefore, there is a possibility that the clip will scratch or otherwise mar or damage the film frame immediately adjacent the strip edge to which the clip is applied. This particularly is the case when one or both of the end frames of the film strip are close to the edge of the strip. Further, at least some liquid retained on a strip which is suspended to dry will run down the strip to drip off. In instances where a clip is positioned at the bottom of the strip to prevent curling thereof, the dripping liquid will accumulate and be retained on or along the clip edge at that location of the strip rendering the bottom of the strip soggy and requiring longer drying time.

The device of the present invention avoids possible damage to a frame of the film strip being dried because the device is not secured directly to the surface of the film and therefore cannot scratch or otherwise mar a film frame. Further, the device of the invention does not permit accumulation and retention of liquid at the bottom edge of a strip suspended for drying because the device is not secured directly to the surface of the strip; rather, the device of the invention is secured within the sprocket holes of the film strip and is spaced from the lower edge of the film. Any liquid which drips to the lower edge of the film thereby is permitted to fall away from the film and does not accumulate thereon.

SUMMARY OF THE INVENTION

The invention is characterized by a member having a body portion with at least one pair of hook extensions protruding from an edge thereof. The hook extensions are spaced apart along said edge to correspond with the spacing between opposite rows of sprocket holes provided along a conventional strip of photographic film. The hook extensions are adapted to be positioned within respective end sprocket holes of the film strip and thereby retain the body portion upon the film strip but in spaced disposition with respect to the edge thereof. The member may be positioned at an uppermost edge of a film strip to enable suspension thereof during the drying step of developing of the film. A like member may be positioned at the lowermost edge of the suspended film strip to function as a weight and prevent the strip from curling as it is drying.

BRIEF DESCRIPTION OF THE DRAWING

FIG. 1 is a perspective view illustrating two of the members constructed in accordance with the invention, one of said members being positioned at the top edge of a strip of film suspended for drying and the other of said members being positioned at the bottom edge of the film strip to prevent the same from curling during drying;

FIG. 2 is a side plan view of one of said members;

FIG. 3 is a front plan view of one of said members as seen from the direction 3—3 of FIG. 2; and FIG. 4 is a perspective view of a modified form of one of said members.

DESCRIPTION OF THE PREFERRED EMBODIMENTS

The device of the invention comprises member 10 including a body portion 12 which in its preferred form is of generally rectangular configuration. Body portion 12 includes respective opposite parallel side edges 14, 16 and respective opposite parallel side edges 18, 20 which are shorter than edges 14, 16 and disposed normal thereto. It is to be understood that the precise configuration of body portion 12 may be other than rectangular and still come within the scope of the invention as contemplated. For example, the body 12 may take the form of a square, circle or any other suitable geometric configuration.

Attached along at least one elongate edge 14 of body portion 12 are a pair of extension pins or arms 22, 24. Each arm 22, 24 comprises a respective elongate shank part 26, 28 which terminates with a respective partially return-bent hook part 30, 32. In the embodiment shown in FIGS. 1 through 3, extension arms 34, 36 which are identical to arms 22, 24 are attached along the second elongate edge 16 of body portion 12 so that the formation of arms 34, 36 is the mirror image of like formation of arms 22, 24.

The arms 22, 24 are spaced apart along edge 14 a distance X which corresponds to the spacing distance between the parallel rows of sprocket holes 38, 40 of any conventional film strip 42 with which the member 10 is intended for use. Thus, in the preferred embodiment, the member 10 is illustrated for use in conjunction with a conventional strip 42 of 35 mm film and the distance X accordingly would be chosen to be approximately the same as the distance between the parallel rows of sprocket holes 38, 40 of such film strip. The spacing of arms 34, 36 is the same along edge 16 as the spacing of arms 22, 24 along edge 14.

The elongate length Y of arms 22, 24 and arms 34, 36 from the surface of respective edges 14, 16 to the roots 15, 15' of the return-bent hook parts (30, 32 in the case of arms 22, 24) is chosen to be approximately one-half of the length of the shorter side edges 18, 20, although the precise dimension is not as important as the spacing X of the arms along the longer edges of the body portion 12. Each return-bent hook part 30, 32 provides an inner-facing attachment surface 44, 46 for retaining a selected sprocket hole of a film strip as described below. The outer-facing surface 48, 50 of each hook part may be bevelled or otherwise provided with a sharpened surface to facilitate positioning of the hooks within the sprocket holes.

Member 10 and its associated parts may be formed of any suitable material such as plastic or metal. The member could be molded or cast as a one-piece structure or the body and arm portions could be formed separately and thereafter assembled as shown.

In use, after a strip of photographic film 42 has been treated with development liquids and is ready to be hung for drying, one member 10 is positioned at the top edge 50' of the strip by inserting the hook parts of arms 34, 36 within the sprocket holes 52, 54 adjacent said top edge. The film strip will rest within the inner-facing attachment surfaces of the hooks on arms 34, 36 and be supported thereby. The oppositely-facing hook parts on arms 22, 24 are then positioned upon a suitable support member such as horizontally disposed hanging line 60 which is tied to any convenient location (not shown). Another member 10 may be positioned at the bottom edge 62 of the strip by inserting its hook parts on arms 22, 24 within the sprocket holes 64, 66 adjacent to edge 62. The weight of member 10 so positioned at bottom edge 62 will be such as to prevent any undesirable curling of the film strip 42 as it is suspended in the air to dry.

It is to be noted that the member 10 is positioned to support a film strip 42 and also to weight the lower edge thereof without touching or engaging in any manner the surface 70 of the film. As a result, there is no danger of scratching, damaging or otherwise marring the film surface as is the case when pinch clips are used to support or weight a film strip. Further, by reason of the distance Y between the root of hook parts 30, 32 and the edge 14 of the body portion 12 which faces the lower edge 62 of the film strip, any liquid which drips from said edge 62 will fall away from the strip and not accumulate thereon.

The embodiment shown in FIGS. 1 through 3 specifically is intended for use in instances when a film strip is to be hung from a hanging line 60 to be dried. There may be instances when it is desired to hang a film strip to be dried from a pin in a vertical surface as shown in FIG. 4. In this instance, an aperture 72 is provided in the body portion 12 proximate one elongate edge 14 thereof to permit passage therethrough of support pin 74 positioned in wall 76 and support the member 10' with film strip 42 suspended therefrom. Member 10' shown in FIG. 4 has one pair of arms 22, 24 positioned on edge 16 only since arms on the opposite elongate edge 14 of the member 10' are not required. However, it should be noted that member 10 with two oppositely facing pairs of arms mounted thereon could be provided with an aperture 72' for use in conjunction with a pin 74 if desired and the second pair of arms would not interfere with such use. Members 10, 10' also could be used in conjunction with a hanging line by stringing the same through aperture 72, 72'. Further, several members 10 could be used in instances where it is desired to suspend two or more strips of film in tandem for drying. Thus, in FIG. 1 a second strip of film (not shown) could be suspended from the lowermost member 10 with another member 10 positioned at the bottom edge of said second strip to prevent the same from curling during drying. Other strips of film could be suspended below the said second strip in the same manner.

As a further modification, body portion 12 could be formed as a magnifying lens by molding the same of clear material with appropriate curved surfaces. In such case, the device of the invention would be usable as a convenient member to magnify for viewing images on a film strip with which the member is used. Alternatively to forming the entire body portion 12 as a magnifying lens, an appropriate lens insert 80 could be positioned within the body 12 and function in the same manner.

Minor variations in the structure and other variations in the arrangement and size of the various parts may occur to those skilled in the art without departing from the spirit of circumventing the scope of the invention as set forth in the appended claims.

I claim:

1. A device for use in the selective supporting and weighting of a strip of photographic film having parallel rows of sprocket holes in hanging disposition comprising, a one-piece body including a pair of opposed surfaces, arm means rigid with and projecting beyond one of said surfaces to terminate in an outer end remote from said surface, a pair of return bent hooks rigid with said arm means proximate the outer end thereof and projecting laterally therefrom, the hooks of said pair of hooks being spaced from each other a distance approximately the same as the distance between the parallel rows of sprocket holes whereby said pair of hooks may be inserted within respective ones of the sprocket holes and means on said body engageable with a support for suspending the strip in said hanging disposition.

2. The device of claim 1 including second arm means rigid with and projecting beyond the second of said surfaces to terminate in an outer end remote from said second surface, and a second pair of return bent hooks rigid with said second arm means proximate the outer end thereof and projecting laterally therefrom, the hooks of said second pair of hooks being spaced from each other a distance approximately the same as the distance between the parallel rows of sprocket holes and selectively constituting both said means for suspending the strip and means for insertion within respective ones of the sprocket holes.

3. The device of claim 2 including a support receiving aperture defined therethrough.

4. The device of claim 2 including a magnifying lens in said body.

5. The device of claim 2 in which said body and arm means are formed of one-piece molded plastic.

* * * * *